US009090102B2

(12) United States Patent
Kagami et al.

(10) Patent No.: US 9,090,102 B2
(45) Date of Patent: Jul. 28, 2015

(54) LIQUID EJECTING APPARATUS AND LIQUID EJECTING PRINTING APPARATUS

(75) Inventors: Kazuyuki Kagami, Shiojiri (JP); Takayuki Tamaki, Shiojiri (JP); Satoru Miura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 433 days.

(21) Appl. No.: 12/913,189

(22) Filed: Oct. 27, 2010

(65) Prior Publication Data

US 2011/0102505 A1 May 5, 2011

(30) Foreign Application Priority Data

Oct. 29, 2009 (JP) ..... 2009-248534

(51) Int. Cl.
*B41J 2/165* (2006.01)
*B41J 11/00* (2006.01)
*B41J 3/54* (2006.01)

(52) U.S. Cl.
CPC ..... *B41J 11/002* (2013.01); *B41J 3/543* (2013.01)

(58) Field of Classification Search
None
See application file for complete search history.

(56) References Cited

U.S. PATENT DOCUMENTS

| | | | | |
|---|---|---|---|---|
| 7,137,695 | B2 * | 11/2006 | Yokoyama | 347/102 |
| 2004/0189769 | A1 * | 9/2004 | Wilbur et al. | 347/102 |
| 2006/0227194 | A1 | 10/2006 | Hoshino | |
| 2007/0109382 | A1 * | 5/2007 | Lafleche et al. | 347/102 |
| 2009/0015621 | A1 * | 1/2009 | Hirota et al. | 347/19 |
| 2011/0102526 | A1 | 5/2011 | Tamaki | |
| 2011/0102527 | A1 | 5/2011 | Tamaki | |

FOREIGN PATENT DOCUMENTS

JP 2006-289722 10/2006

* cited by examiner

*Primary Examiner* — Alejandro Valencia
(74) *Attorney, Agent, or Firm* — Workman Nydegger

(57) ABSTRACT

A carriage apparatus of an ink jet recording apparatus, which discharges a photocurable ink and photocures the discharged ink, thereby forming a desired image on the recording medium, includes a plurality of recording heads for discharging the ink with respect to the recording medium; a recording carriage on which the plurality of recording heads is mounted so as to be divided into a plurality of recording portions; a plurality of photocuring units which is disposed to photocure the ink on the recording medium; and a photocuring carriage on which a plurality of photocuring units is mounted and which is disposed in a plane with a gap between the photocuring carriage and the recording carriage, wherein, in the photocurable carriage, a plurality of holding portions for holding the respective photocuring units forms a narrow part, respectively and is connected with each other.

12 Claims, 9 Drawing Sheets

LIQUID EJECTING APPARATUS AND LIQUID EJECTING PRINTING APPARATUS

BACKGROUND

1. Technical Field

The present invention relates to a carriage apparatus of an ink jet recording apparatus which discharges a photocurable functional liquid to a recording medium by an ink jet type recording head, irradiates and cures the functional liquid landed on the recording medium with light, thereby forming an image on the recording medium, and an ink jet recording apparatus equipped therewith.

2. Related Art

In the related art, there is known an ink jet recording apparatus that has a plurality of coloring (color) ink recording heads (Y, M, C, and K) arranged in a transport direction (a sub scan direction) of the recording medium, one transparent (colorless) ink recording head, and an ultraviolet irradiation apparatus disposed at both outer sides of the recording head, and draws an image on the recording medium, while moving a head unit, which is configured by mounting the recording heads and the ultraviolet irradiation apparatus on a carriage, in a main scan direction and moving the recording medium in a sub scan direction, respectively (see JP-A-2006-289722). In the ink jet recording apparatus, it is configured that the color ink and the colorless ink are discharged and landed with respect to the recording medium, respectively and cured by an ultraviolet irradiation apparatus, thereby forming a desired image on the recording medium.

However, in the above-mentioned ink jet recording apparatus, since a plurality of the recording heads and light irradiation units are mounted on the same carriage, heat generated from the respective ultraviolet irradiation apparatuses is transferred to the respective recording heads via the carriage. For this reason, there occurs a problem that, in the recording heads, viscosity of ink is changed and the discharging amount is changed or distortion is generated in the carriage. That is, there is a problem in that, due to the thermal influence of the ultraviolet light irradiation apparatus, the formation of the image or the curing of ink is not satisfactorily performed, whereby the printing quality deteriorates.

SUMMARY

An advantage of some aspects of the invention is to provide a carriage apparatus of an ink jet recording apparatus which can exclude the thermal influence between the photocuring unit and the recording head and between the adjoining photocuring units, and an ink jet recording apparatus equipped therewith.

According to an aspect of the invention, there is provided a carriage apparatus of an ink jet recording apparatus, which discharges a photocurable ink and photocures the discharged ink, while relatively being moved with respect to a recording medium in a main scan direction and a sub scan direction, thereby forming a desired image on the recording medium, including a plurality of recording heads for discharging the ink with respect to the recording medium; a recording carriage on which the plurality of recording heads is mounted so as to be divided into a plurality of recording portions in the sub scan direction; a plurality of photocuring units which is disposed in outer sides of the respective recording portions in the main scan direction to photocure the ink on the recording medium; and a photocuring carriage on which a plurality of photocuring units is mounted and which is disposed in a plane with a gap between the photocuring carriage and the recording carriage, wherein, in the photocurable carriage, a plurality of holding portions for holding the respective photocuring units forms a narrow part, respectively and is connected with each other.

According to the aspect of the invention, the respective recording heads are mounted on the recording carriage, and the respective photocuring units are mounted on the photocuring carriage, respectively, and the recording carriage and the photocuring carriage are disposed so as to be physically separated from each other without contact. Thus, heat generated from the respective photocuring units is not transferred to the recording carriage (and the respective recording heads). That is, heat of the photocuring units does not influence the recording heads. Furthermore, in the photocuring carriage, the holding portions are connected to each other so as to form the narrow part. Thus, it is possible to obtain a configuration in which a heat transfer area between the holding portions can be extremely reduced, whereby the heat generated by the photocuring unit mounted on one holding portion is not easily transferred to the adjacent photocuring unit. As a result, since the thermal influence between the photocuring units can be excluded, the light emitting performance of the respective photocuring units does not decline. Thus, it is possible to exclude the thermal influence from a single arbitrary photocuring unit to the recording head or other photocuring units, whereby the formation of the image or the curing of the ink is satisfactorily performed, which can satisfactorily maintain the printing quality.

In this case, preferably, the plurality of photocuring units is disposed at both outer sides of the respective recording portions in the main scan direction, and the photocuring carriage has a pair of carriage side portions in which the plurality of holding portions forms the narrow part and is connected to each other and which are symmetrically situated at both sides in the main scan direction of the plurality recording portions, and a carriage connection portion that connects the pair of carriage side portions.

According to the configuration of the aspect of the invention, in a case where the carriage apparatus moves back and forth in the main scan direction, immediately after discharging the ink during forward movement, the ink can be photocured by the photocuring unit. In addition, only the discharging of the ink may be performed during forward movement, and the photocuring may be performed during backward movement. As a result, the time up to the photocuring of the ink can be flexibly controlled, so that the surface roughness of the image to be formed can be arbitrarily set. In addition, if the photocuring is performed immediately after the ink is landed on the recording medium, the surface becomes rough.

In this case, preferably, the recording carriage is supported so as to be movable with respect to a guide shaft in the main scan direction, in an upstream side of the sub scan direction, and the plurality of recording portions is disposed from the guide shaft toward a downstream side of the sub scan direction, in order from the recording portion that mounts the greatest number of the recording heads.

According to the configuration, since the carriage apparatus is supported by the guide shaft in the recording portion side of a great mass, the influence of inertia is suppressed and a stable movement is possible, whereby it is possible to prevent the vibration due to the inertia during movement start and stop. As a result, slurring or overrun of the recording carriage (the plurality of recording portions) can be suppressed, whereby the highly precise image forming can be performed.

In this case, mutual confronting sides of the recording carriage and the photocuring carriage are preferably formed in a complementary shape and in a step shape, respectively.

According to the configuration, it is possible to dispose the plurality of recording portions and the plurality of photocuring units in a compact manner. As a result, since the carriage apparatus itself can be configured in a compact manner, it is possible to suppress an adverse effect due to inertia during movement start and stop.

In this case, it is desirable that a photo gap adjustment unit, which adjusts the gap between the plurality of photocuring units and the recording medium via the photocuring carriage, is further included.

Furthermore, in this case, it is desirable that a head gap adjustment unit, which adjusts the gap between the plurality of recording heads and the recording medium via the recording carriage, is further included.

According to the configuration, the photo gap adjustment unit can suitably change the gap between the respective photocuring units and the recording medium depending on the thickness of the type (impermeable or permeable to ink) of the recording medium. As a result, light of optimal intensity (illuminance) can be irradiated depending on the type of ink or the type of recording medium, whereby the ink on the recording medium can be suitably cured.

Similarly, the head gap adjustment unit can suitably change the gap between the respective recording heads and the recording medium depending on the thickness of the recording medium or the like. As a result, the optimal discharging of ink can be performed, and highly precise image can be formed on the recording medium.

Furthermore, by individually providing the photo gap adjustment unit and the head gap adjustment unit to individually perform the gap adjustment, the photocuring condition and the discharging condition can be flexibly changed.

In this case, preferably, the respective photocuring units have a light irradiation portion which irradiates light for photocuring the ink, and a cooling portion which is disposed in a rear side of the light irradiation unit and cools the light irradiation portion, and the photocuring carriage has a rib which protrudes to the recording carriage side to shield the discharged heat from the cooling portion.

According to the configuration, since heat generated from the respective light irradiation portions is effectively discharged, it is possible to prevent a decline in the light emitting performance due to the heat of the light irradiation portion, thereby stably photocuring the ink. Furthermore, the rib can physically shield the heat discharging from the cooling portion with respect to the respective recording heads (recording carriage). As a result, a decline in the performance of the photocuring unit and the recording head can be effectively prevented.

An ink jet recording apparatus of another aspect of the invention includes the carriage apparatus of the ink jet recording apparatus, and a movement unit which moves the carriage apparatus in the main scan direction and moves the recording medium in the sub scan direction.

According to the configuration, since heat generated by the photocuring unit is not easily transferred to the recording carriage (and the respective recording heads), a decline in discharging accuracy of the recording head due to the heat is prevented, whereby it is possible to form a high precision image with respect to the recording medium.

According to a second aspect of the invention, there is provided a carriage apparatus of an ink jet recording apparatus, which discharges a photocurable ink with respect to a recording medium and photocures the discharged ink, thereby forming a desired image on the recording medium, including a plurality of recording heads for discharging the ink with respect to the recording medium; a recording carriage on which the plurality of recording heads is mounted so as to be divided into a plurality of recording portions; a plurality of photocuring units which is disposed corresponding to the respective recording portions to photocure the ink on the recording medium; and a photocuring carriage on which a plurality of photocuring units is mounted and which is disposed in a plane with a gap between the photocuring carriage and the recording carriage, wherein, in the photocurable carriage, a plurality of holding portions for holding the respective photocuring units forms a narrow part, respectively and is connected with each other.

According to the configuration, the respective recording heads are mounted on the recording carriage, and the respective photocuring units are mounted on the photocuring carriage, respectively, and the recording carriage and the photocuring carriage are disposed so as to be physically separated from each other without contact. Thus, heat generated from the respective photocuring units is not transferred to the recording carriage (and the respective recording heads). That is, heat of the photocuring units does not influence the recording heads. Furthermore, in the photocuring carriage, the holding portions are connected to each other so as to form the narrow part. Thus, it is possible to obtain a configuration in which a heat transfer area between the holding portions can be extremely reduced, whereby the heat generated by the photocuring unit mounted on one holding portion is not easily transferred to the adjacent photocuring unit. As a result, since the thermal influence between the photocuring units can be excluded, light emitting performance of the respective photocuring units does not decline. Thus, it is possible to exclude the thermal influence from a single arbitrary photocuring unit to the recording head or other photocuring units, whereby the formation of the image or the curing of the ink is satisfactorily performed, which can satisfactorily maintain the printing quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
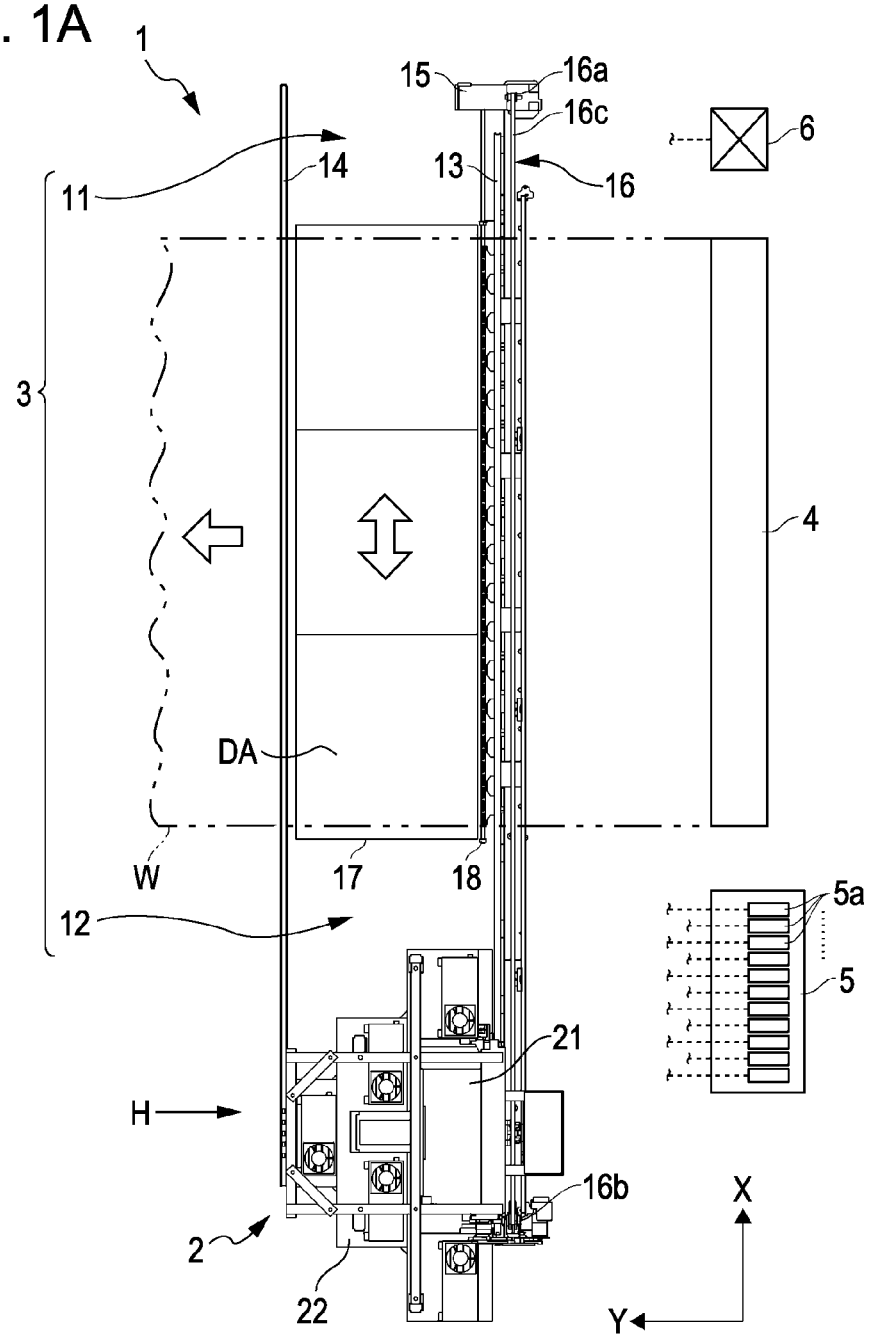
FIG. 1A is a plan view that schematically shows an inner part of an ink jet recording apparatus according to an embodiment (a first embodiment) of the invention.

Hereinafter, an ink jet recording apparatus according to an embodiment of the invention will be described with reference to the attached drawings. The ink jet recording apparatus is an apparatus in which an ultraviolet-curable ink is discharged from a recording head with respect to a recording medium, then, ultraviolet light is irradiated from an ultraviolet irradiator, the ultraviolet curable ink landed on the recording medium is cured, thereby forming (drawing) image on the recording medium.

First Embodiment

As shown in FIG. 1, an ink jet recording apparatus 1 includes, in an exterior (not shown) thereof, a carriage apparatus 2 on which a head unit 21 having a plurality of ink jet type recording heads 30 and a photocuring units 22 are mounted, respectively; a movement unit 3 for relatively moving the carriage apparatus 2 and a recording medium W; a medium supply unit 4 in which the recording medium W before drawing is set; an ink supply unit 5 which supplies the plurality of recording heads 30 with a plurality of colors of ultraviolet curable ink (hereinafter, referred to as "ink"); and a control unit 6 which controls the formation processing of the image by the ink jet recording apparatus 1.

Furthermore, although it is not shown, at a home position H side (a lower side in FIG. 1A) of the carriage apparatus 2, a repair unit for preventing the nozzle blockage or the like of the respective recording heads 30 is disposed. The repair unit includes a capping unit for sealing nozzle forming surfaces of the respective recording heads 30, an absorption unit for forcibly absorbing the ink from the respective recording heads 30, and a wiping unit for wiping the forming surfaces of nozzle holes 36 of the respective recording heads 30.

Figure 1B:
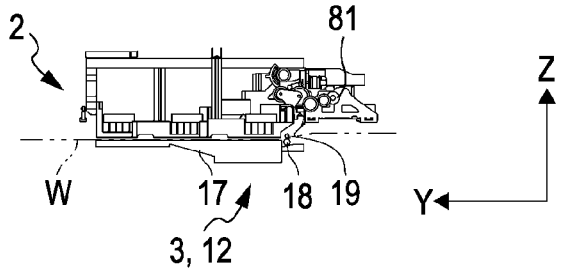
FIG. 1B is a side view thereof.

As shown in FIGS. 1A and 1B, a movement unit 3 includes a head movement mechanism 11 which moves the carriage apparatus 2 in a main scan direction (hereinafter, referred to as "X axis direction"), and a medium transport mechanism 12 which moves the recording medium W in a sub scan direction (hereinafter, referred to as "Y axis direction"), thereby transporting the recording medium W to a position (a drawing area DA) facing the carriage apparatus 2.

The head movement mechanism 11 includes a first guide shaft 13 and a second guide shaft 14 which support the carriage apparatus 2 so as to be movable in the X axis direction, a servo motor 15 which becomes a driving source for moving the carriage apparatus 2, and a belt transmit mechanism 16 which transmits the rotational movement force of the servo motor 15 to the carriage apparatus 2, thereby moving the carriage apparatus 2 back and forth in the X axis direction.

The belt transmit mechanism 16 has a driving pulley 16*a*, which is connected to the servo motor 15 and is disposed in one end portion in the X axis direction, a driven pulley 16*b* which is disposed in the other end portion in the X axis direction, and an endless timing belt 16*c* which spans between the driving pulley 16*a* and the driven pulley 16*b*. A base portion of the carriage apparatus 2 is connected to one place of the timing belt 16*c* via a belt fixing portion 62 described later, so that when the servo motor 15 rotates forwardly and backwardly, the carriage apparatus 2 moves back and forth in the X axis direction via the timing belt 16*c*.

The first guide shaft 13 is a shaft, in which an upper part is formed in the shape of a semicircular shape in section, and is disposed so as to traverse the recording medium W supplied to the drawing area DA in a width direction (X axis direction) in the upstream side of the Y axis direction of the drawing area DA. Although it is not shown, the first guide shaft 13 is supported on an apparatus frame (not shown) by a plurality of support members in an extending direction, whereby flexure in an up and down direction is prevented. Similarly, the second guide shaft 14 is a shaft having an approximately rectangular section, and is disposed in parallel to the first guide shaft 13 in a downstream side of the Y axis direction of the drawing area DA. The lengths of the first guide shaft 13 and the second guide shaft 14 are set so as to be adapted to a maximum width of the suppliable recording medium W. In addition, the carriage apparatus 2 is configured so that the base portion thereof is supported on the first guide shaft 13 and the front end side thereof is supported on the second guide shaft 14, and they are guided to the first guide shaft 13 and the second guide shaft 14 and moves back and forth in the X axis direction.

The servo motor 15 can control the position of the carriage apparatus 2 in the X axis direction and is disposed so that the drive shaft thereof faces the upstream side of the Y axis direction at an opposite side (an upper side in FIG. 1A) of the home position H of the carriage apparatus 2. The carriage apparatus 2 moves back and forth along the first guide shaft 13 and the second guide shaft 14 via the timing belt 16*c* through the forward and backward rotation driving of the servo motor 15. In addition, the servo motor 15 controls the carriage apparatus 2, which moves on the recording medium W (the drawing area DA) in the X axis direction, to have a constant rate.

The medium transport mechanism 12 includes a platen 17 which supports the recording medium W from a rear surface (non-recording surface), a transport roller 18 which contacts the recording medium W at the rear surface thereof and transports the recording medium W in the Y axis direction, a medium pressing roller 19 (see FIG. 1B) which confronts the transport roller 18 via the recording medium W, and a transport motor (not shown) which rotates the transport roller 18 to intermittently transport the recording medium W. In addition, the recording medium W is intermittently transported by setting the length of a nozzle row NL (see FIG. 4B) of the recording head 30 as one pitch.

On the front surface of the platen 17, a plurality of small holes (not shown) in the shape of a matrix (or zigzag shape) is formed so as to be penetrated toward the rear surface thereof. At the lower part of the platen 17, an absorption fan (not shown) is provided. By rotating and driving the absorption fan, absorption force is caused to act on the recording medium W on the platen 17 via the plurality of small holes, whereby the recording medium W is positioned and fixed on the platen 17 with a uniform degree of planarity. As a result, the drawing process can be performed with respect to the recording medium W without distortion, which makes it possible to form a highly precise image without deviation regarding the landing position of ink.

The transport roller 18 and the medium pressing roller 19 are situated at the lower part of the first guide shaft 13, i.e., at an upstream side in the Y axis direction of the drawing area DA. The medium pressing roller 19 is a driven roller which rotates together with the transportation of the recording medium W due to the rotation of the transport roller 18, and presses the recording medium W on the transport roller 18 from the upper part. That is, the transport roller 18 and the medium pressing roller 19 includes a nip roller, which is constituted by a driving roller and a driven roller, respectively, and transports the recording medium W when the movement of the carriage apparatus 2 is stopped. In addition, at the downstream side of the platen 17, a paper discharge roller, which transports the recording medium W while being slip rotated, may be provided.

The medium supply unit 4 has a recording medium W to be provided for the drawing set therein and is a supply source of the recording medium W. The form of the recording medium W used in the present embodiment may be any form such as a roll shape, a cut sheet shape or the like. In particular, although it is not shown, with respect to the former recording medium W, the paper is transported in a roll to roll manner, and, with respect to the latter recording medium W, the paper is transported from the paper cassette one sheet at a time by the paper feeding roller. In addition, as the recording medium W, one, which is formed of a material such as a paper (a normal paper, a glossy paper or the like), cloth (non-woven fabric), resin, a metal, a glass or the like, can be applied.

The ink supply unit 5 includes a plurality of ink packs 5*a* in which color or colorless ink is contained, respectively, and the respective ink packs 5*a* are connected to the respective recording heads 30 via the ink supply flow path (not shown). Each color ink is supplied to the respective recording head 30 through the respective ink supply flow paths, by pressurizing each ink pack 5*a* from the outer side (atmospheric pressure). Furthermore, the respective ink supply flow path and the respective recording heads 30 are covered with a film heater (not shown) which heats the ink flowing in the respective ink supply flow path. Each color ink is adjusted to a predetermined viscosity by being heated by the film heater and is supplied to the respective recording head 30.

In addition, the ultraviolet curable ink is classified into a radical polymerization system ink including a radical polymerizable compound as a polymerizable compound and a cationic ion polymerization system ink including a cationic polymerizable compound. However, in the present embodiment, any of these may be used. Furthermore, the ultraviolet curable inks used in the present embodiment are ten colors of cyan (C), magenta (M), yellow (Y), black (K), orange (Or), green (Gr), light magenta (LM), light cyan (LC), white (W), clear (CL), but the color (hue) and number of colors are not limited thereto.

Figure 2A:
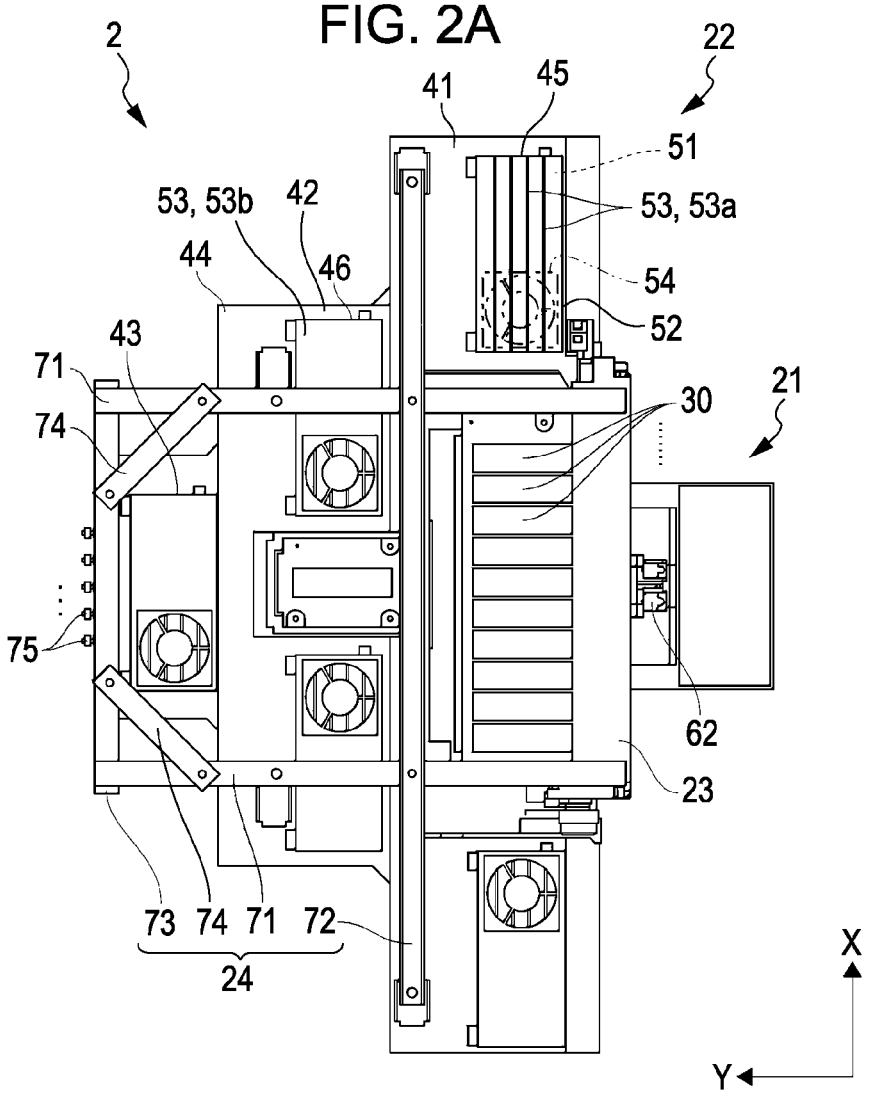
FIG. 2A is a plane view of a carriage apparatus.
Figure 2B:
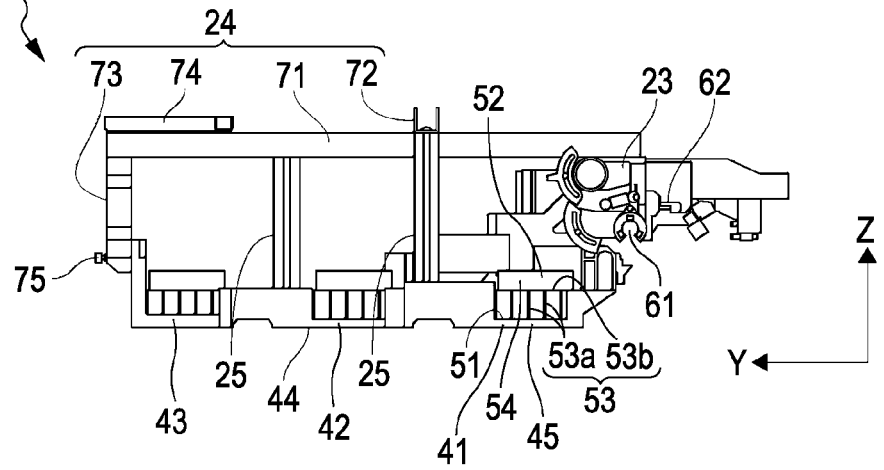
FIG. 2B is a side view thereof.

Next, the carriage apparatus 2 will be described in detail with reference to FIGS. 2A to 6C. As shown in FIGS. 2A and 2B, the carriage apparatus 2 includes a head unit 21 for discharging the ink with respect to the recording medium W, a photocuring unit 22 for curing the ink landed on the recording medium W, a carriage base 23 which is supported slidably on the first guide shaft 13, a support frame portion 24 which spans the second guide shaft 14 and the carriage base 23 and is supported slidably on the second guide shaft 14, and a plurality of pillar members 25 for hanging the photocuring unit 22 on the support frame 24. The carriage apparatus 2 faces the recording medium W fixed on the platen 17, performs the discharging of the ink from the head unit 21 onto the recording medium W, while being moved back and forth in the X axis direction by the head movement mechanism 11, and performs the curing of the ink landed on the recording medium W, by the photocuring unit 22.

Furthermore, the carriage apparatus 2 includes a head gap adjustment unit 26 (see FIGS. 5A and 5B) for adjusting the gap between the head unit 21 and the recording medium W, a parallelism adjustment unit 27 (see FIGS. 5A and 5B) for adjusting a roll angle (parallelism to the recording medium W) of the head unit 21, and a photo gap adjustment unit 28 (see FIGS. 6A to 6C) for adjusting the gap between the photocuring unit 22 and the recording medium W.

Figure 3:
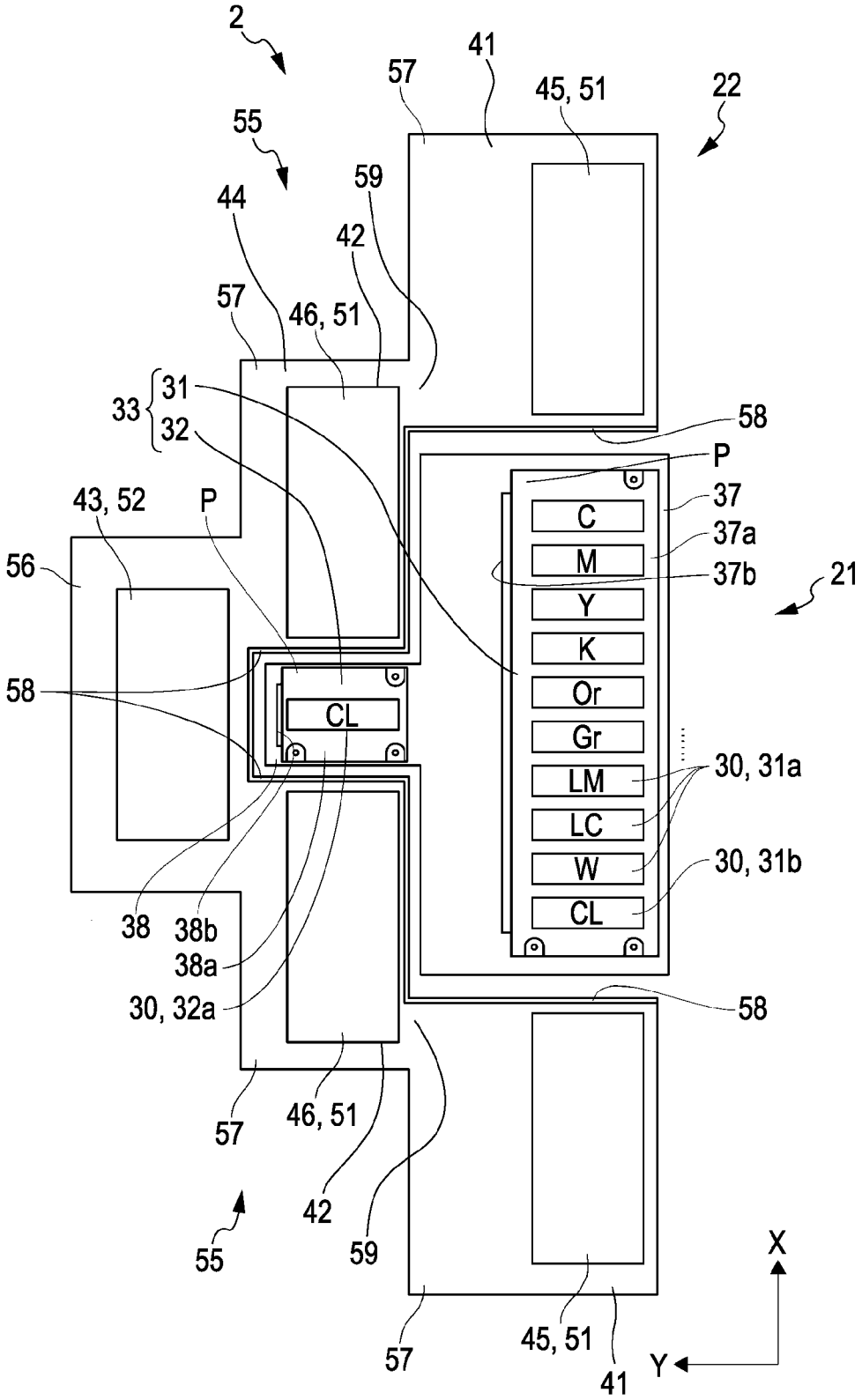
FIG. 3 is a plane view that schematically shows a heat unit and a photocuring unit of a carriage apparatus.

As shown in FIGS. 2A, 2B, and 3, the head unit 21 includes a first recording portion 31, which has a plurality of recording heads 30 for discharging the color ink and the colorless ink with respect to the recording medium W, a second recording portion 32, which has one recording head 30 (a second recording head 32*a*) for discharging an arbitrary ink with respect to the recording medium W, and a recording carriage 33 which organizes and mounts the first recording portion 31 and the second recording portion 32 in the Y axis direction.

Figure 4A:
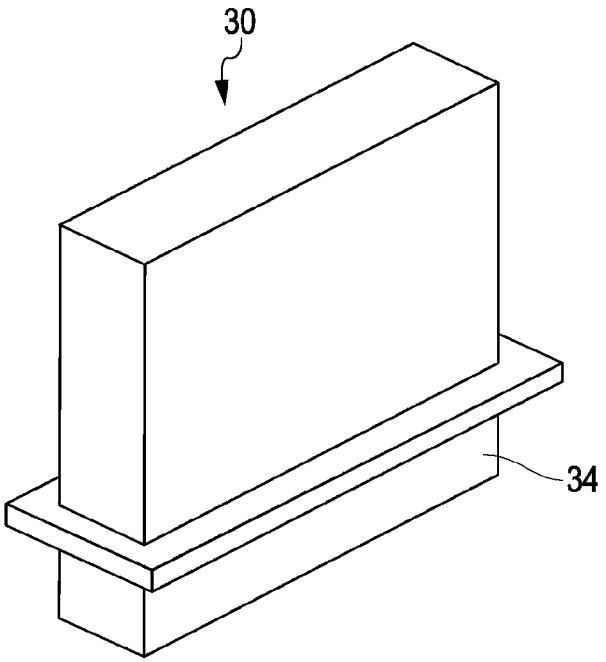
FIGS. 4A and 4B are surface and rear perspective views that schematically show a recording head.
Figure 4B:
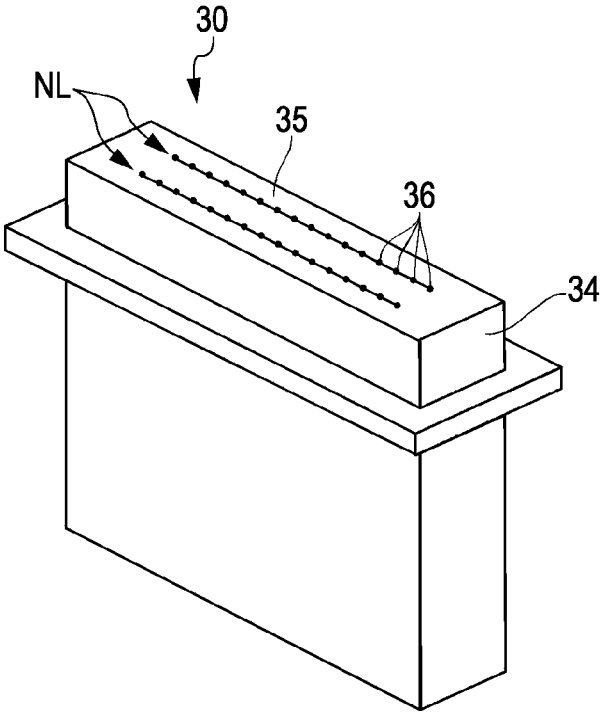

As shown in FIGS. 4A and 4B, the recording head 30 includes a pump portion 34 which discharges the ink in a so-called ink jet manner and to which the ink supply flow path is connected and ink is supplied, and a nozzle plate 35 which is lined on the pump portion 34. Two rows of nozzle rows NL are arranged on the nozzle surface of the nozzle plate 35 in parallel to each other, and each nozzle row NL includes a plurality of nozzle holes 36 arranged at regular pitches. In addition, the number of the nozzle rows NL and the number of the nozzle holes 36 are arbitrary. Furthermore, two pump portions 34 are formed so as to correspond to the nozzle rows NL of each row. The above-mentioned control unit 6 is connected to the recording head 30 via a flexible flat cable (not shown), whereby ink is discharged from the respective nozzle holes 36 by application of the driving waveform output from the control unit 6 to a piezoelectric element (not shown) of the pump portion 34.

As shown in FIGS. 2A, 2B, and 3, the first recording portion 31 is fixed to the first head plate 37*a* in the state in which ten recording heads 30 are arranged in a row at equal intervals in the X axis direction so that the nozzle row NL faces in the Y axis direction. The ten recording heads 30 mounted on the first recording portion 31 are configured so that a plurality of first color recording heads 31*a* for discharging color (C, M, Y, K, Or, Gr, LM, LC, and W) inks and a single first colorless recording head 31*b* for discharging colorless (CL) ink are arranged in a row in the X axis direction. In the present embodiment, C, M, Y, K, Or, Gr, LM, LC, W, and CL inks are introduced (supplied) into the recording head 30 (the respective first color recording head 31*a* and first colorless recording head 31*b*) from an upper end in FIG. 3, whereby the respective recording heads 30 discharge each color ink. In addition, the number of the recording heads 30 is arbitrary, and the sequence of the color of the ink to be supplied is also arbitrary.

On the other hand, the second recording portion 32 is configured so that single recording head 30 (hereinafter, referred to as second recording head 32*a*) is fixed to the second head plate 38*a* with the nozzle row NL facing the Y axis direction. The colorless (CL) ink is supplied to the second recording head 32*a*. Furthermore, the number of the second recording heads 32*a* is arbitrary. However, although the details thereof will be described later, considering the suppression and the like of the cantilever support of the recording carriage 33 or the occurrence of mist, preferably, the number of the second recording heads 32*a* is smaller than that of the mounting onto the first recording portion 31, and, optimally, the number of the second recording heads 32*a* is one or two. Moreover, the colorless ink to be supplied to the second recording head 32*a* is the same as the ink to be supplied to the first colorless recording head 31*b*, and ink, which differs in viscosity, curing property, gloss during curing or the like, may be used.

The recording carriage 33 is integrally formed with a first head holding portion 37 which is formed in a square shape having a long side in the X axis direction, a second head holding portion 38 which is formed in a square shape smaller than the first head holding portion 37, and a pair of standing portions 39 (see FIGS. 5A and 5B) stood up at both ends in the X axis direction of the first head holding portion 37. The second head holding portion 38 is formed so as to protrude from the center of the X axis direction toward the downstream side of the Y axis direction of the first head holding portion 37. That is, in the plane, the recording carriage 33 is formed in the shape of a step.

In the first head holding portion 37, a first head opening 37*b*, which faces the first head plate 37*a* in which the plurality of first color recording heads 31*a* and first colorless recording heads 31*b* are positioned and fixed, is penetrated and formed in the thickness direction (the Z axis direction). Similarly, in the second head holding portion 38, a second head opening 38*b*, which faces the second head plate 38*a* in which the second recording head 32*a* is positioned and fixed, is penetrated and formed in the thickness direction. Furthermore, in the vicinity of the first head opening 37*b* and the second head opening 38*b*, one (total three) positioning pin P is stood up, respectively. By inserting the respective positioning pin P into positioning holes (not shown) of the first head plate 37*a* and the second head plate 38*a*, the first head plate 37*a* is fixed with respect to the first head holding portion 37 and the second head plate 38*a* is fixed with respect to the second head holding portion 38, in a state of being positioned in the X axis direction, Y axis direction and yawing direction, respectively (three screw fixing). In this manner, the first recording portion 31 and the second recording portion 32 are grouped and mounted on the recording carriage 33, and the nozzle plates 35 (of the nozzle surface) of the respective recording heads 30 confront the recording medium W transported on the platen 17.

The recording carriage 33 is supported on the carriage base 23 at the upstream side in the Y axis direction of the first head holding portion 37 in a cantilever manner, and the downstream side in the Y axis direction of the second head holding portion 38 becomes a free end. That is, it is arranged in the sequence in which the mounting number of the recording head 30 is small in a direction separated from the first guide shaft 13. In this manner, by supporting the head unit 21 in the cantilever manner, it is possible to accurately and easily perform the adjustment unique to the head unit 21 such as the gap adjustment or the parallelism adjustment relative to the recording medium W. In addition, in the head unit 21, the recording portion mounted with a great number of recording heads 30 is provided at the first guide shaft 13. Thus, stable movement with little influence of inertia is possible, which makes it possible to prevent the vibration due to the inertia during movement start and stop. As a result, the slurring or overrun of the recording carriage 33 can be suppressed, and the deviation in landing position of ink onto the recording medium W is not generated, whereby the highly precise image can be formed (drawn).

As shown in FIGS. 2A, 2B, and 3, the photocuring unit 22 includes a first half curing portion 41 which performs the half curing of the discharged ink by the first recording portion 31, a second half curing portion 42 which performs the half curing of the discharged ink by the second recording portion 32, a main curing unit 43 which performs the main curing of the discharged ink by the first recording portion 31 and the second recording portion 32, and a photocuring carriage 44 which is mounted with the first half curing portion 41, the second half curing portion 42 and the main curing unit 43.

The first half curing portion 41 has a pair of first half curing units 45 situated at both ends in the X axis direction of the first recording portion 31 and is adapted to face the respective ink droplets which are discharged from the first recording portion 31 and landed on the recording medium W, together with the reciprocating movement in the X axis direction. Similarly, the second half curing portion 42 has a pair of second half curing units 46 situated at both ends in the X axis direction of the second recording portion 32 and faces the respective ink droplets which are landed on the recording medium W by the second recording portion 32. The first half curing portion 41 and the second half curing portion 42 suppresses the wetting spread of the ink droplets on the recording medium W and prevents the ink droplets from beginning to flow when the recording medium W is transported, by performing the half curing of the ink droplets landed on the recording medium W. As a result, the ink droplets can be prevented from being mixed (color mixing) with each other on the recording medium W, and each ink droplet can be arranged in a certain size. In addition, the half curing described herein means a partial curing in the ink droplets and refers to a state in which the ink droplets are partially cured, but are not completely cured, and is a state in which the landed ink is cured to the level that the landed ink droplets have no inferiority by visual inspection and are not completely mixed with the adjacent ink droplets and are in a state of being smoothened so that the surface has a somewhat glossy property.

Herein, the second half curing unit 46 (the second half curing portion 42) can irradiate ultraviolet light having irradiance lower than the first half curing unit 45 (the first half curing portion 41) using the electric current control. For this reason, the colorless ink droplets discharged from the second recording head 32*a* are not cured from the surface to the inner deep position, but remain wet and spread, which enables the forming of a coat layer D3 (the details thereof will be described later) having the smooth surface. In addition, preferably, the irradiance of ultraviolet light irradiated from the second half curing portion 42 is suitably changed according to the curing property of the ink discharged from the second recording head 32*a*.

The main curing unit 43 is situated downstream in the Y axis direction of the second recording portion 32, and confronts the respective ink droplets which are half cured by the first half curing portion 41 and the second half curing portion 42, due to the reciprocating movement in the X axis direction. The main curing unit 43 completely photocures the inner part of the landed ink droplets, thereby fixing the ink droplets on the recording medium W. Thus, the irradiance (illuminance) of the main curing unit 43 is set to be higher (stronger) than those of the first half curing portion 41 and the second half curing portion 42. The main curing unit 43 is provided at the downstream most side of the carriage apparatus 2, and, after drawing the image by the first recording portion 31 and the second recording portion 32, performs the main curing the ink droplet that forms the image. Furthermore, since the ink droplets on the recording medium W have already been half cured, it is possible to configure the small and light main curing unit 43 having a relatively low output.

The respective first half curing unit 45, the respective second half curing unit 46, and the main curing unit 43 have an approximately identical structure, and have a light irradiation portion 51 including a plurality of LEDs (Light Emitting Diodes) for irradiating ultraviolet light, and a cooling portion 52 for cooling the light irradiation portion 51, respectively. The light irradiation unit 51 is a so-called LED array in which a plurality of chip form of ultraviolet LEDs is disposed in a matrix shape (or a zigzag shape), and constitutes a plane light source as a whole. Furthermore, the respective first half curing units 45, the respective second half curing units 46, and the main curing unit 43 have the width (length in the Y axis direction) of the same length as that of the nozzle row NL of the recording head 30, and the length in the X axis direction is designed so that a predetermined irradiance can be obtained in connection with the movement speed in the X axis direction.

The cooling portion 52 includes a heat sink 53 which is in close contact with the upper surface of the light irradiation portion 51, and a cooling fan 54 which emits the wind (air) toward the heat sink 53. The heat sink 53 is a so-called fin type, and a plurality of standing fins 53*a* respectively extends in the X axis direction, and is disposed in the Y axis direction at equal intervals. The heat sink 53 is covered with the cover 53*b*, and the cooling fan 54 is fixed to the opening portion formed on the upper surface of the cover 53*b*. The cooling fans 54 are situated at the head unit 21 side, respectively, whereby the emitted air is discharged (heat is discharged) to the outside along the fin 53*a* while absorbing the heat from the fin 53*a* of the heat sink 53 by the respective cooling fan 54. As a result, the heat generated from the respective light irradiation portions 51 is effectively discharged, so that a decline in the light emitting performance of the light irradiation portion 51 due to the heat is prevented, which can stably photocure the ink. In addition, the detail will be described later, but the air discharging (heat discharging) from the cooling fan 54 is blocked by a rib 58 which stands up at the recording carriage 33 side of the photocuring carriage 44.

The photocuring carriage 44 includes a pair of carriage side portions 55 that is symmetrically situated at both sides in the X axis direction of the recording carriage 33, and a carriage connection portion 56 that connects the pair of carriage side portions 55. The photocuring carriage 44 is formed integrally by resin in which the suitable reinforced rib is arranged. Thus, it is possible to form a photocuring carriage to be lightweight and at a low cost while maintaining sufficient strength, and which can suppress transmission of heat in the photocuring carriage 44.

The respective carriage side portions 55 have two holding portions 57 for holding the first half curing unit 45 and the second half curing unit 46. The two holding portions 57 are formed in square shapes, respectively, and are connected by a corner portion 59. That is, the carriage side portions 55 are formed in the step shape. In addition, the pair of carriage side portions 55 is symmetrically situated so as to pinch the recording carriage 33 therebetween from both sides in the X axis direction in the plane and is connected by a carriage connection portion 56 at the downstream side in the Y axis direction. Furthermore, the carriage connection portion 56 is also formed in the square shape and holds the main curing unit 43. Thus, the first recording portion 31, the second recording portion 32 mounted on the recording carriage 33, and the main curing unit 43 mounted on the photocuring carriage 44 are arranged in the center of the X axis direction toward the Y axis direction. That is, sequentially from the upstream side in the Y axis direction, the first recording portion 31, the second recording portion 32, and the main curing unit 43 are arranged on the same center line. For this reason, it is possible to form the carriage apparatus 2 which is excellent in weight balance in the X axis direction and to move the carriage apparatus back and forth in the X axis direction at the shortest distance with respect to the width of the recording medium W. As a result, stable movement of the carriage apparatus 2 in the X axis direction is possible and it is possible to suppress the carriage apparatus 2 from becoming larger.

Furthermore, a lot of mist (fogged ink) generated when discharging the ink from the recording head 30 is generated from the first recording portion 31 on which many recording heads 30 are mounted. However, the main curing unit 43 in the present embodiment is provided at a position which is separated from the first recording portion 31 with the second recording portion 32 pinched therebetween. That is, the main curing unit 43 is provided at a position separated from the generating source where a lot of mist is generated and a position separated in the Y axis direction. Thus, it is possible to reduce the risk of the mist becoming attached to the main curing unit 43. As a result, a decline in the light emitting performance (irradiation) of the main curing unit 43 can be suitably prevented to reliably perform the main curing of the ink on the recording medium W, whereby drawing faults due to the non-curing of ink can be effectively prevented.

Furthermore, since the second recording portion 32 has fewer mist generating sources (a single second recording head 32*a*), the mist is less likely to be attached to the main curing unit 43 situated at the downstream side in the Y axis direction. In addition, since the colorless ink is supplied to the second recording head 32*a* as mentioned above, the generated mist is the mist of the colorless ink. Since the colorless mist does not block light (ultraviolet light), even if the mist is attached to the main curing unit 43, the irradiation amount of the ultraviolet light does not decline (or the decline in irradiation amount can be suppressed to a minimum). As a result, the light emitting performance of the main curing unit 43 can be satisfactorily maintained for a long time, which can reduce the frequency of repair (wiping and cleaning).

Furthermore, in the respective holding portions 57, at a side (surface) confronting the recording carriage 33, the rib 58, which stands up perpendicular to the holding portion 57, stands up (see FIG. 3). The rib 58 increases the structural strength of the photocuring carriage 44, and functions as a barrier which blocks the heat discharged by the cooling portion 52 of the first half curing unit 45 or the second half curing unit 46 mounted on the respective holding portions 57. As a result, it is possible to effectively prevent a decline in performance due to the heat of the respective recording heads 30 (the respective first color recording head 31*a*, first colorless recording head 31*b*, and second recording head 32*a*), the respective first half curing units 45 and the respective second half curing units 46.

The photocuring carriage 44 is disposed at the outer side of the recording carriage 33 with a predetermined gap, and a side (surface) where the photocuring carriage 44 and the recording carriage 33 confront each other is complementarily formed. That is, the photocuring carriage 44 covers the recording carriage 33 from the Y axis direction downstream side and is formed in a step shape of a "V" shape. Macroscopically, the recording carriage 33 and the photocuring carriage 44 are formed in a triangle shape which is disposed so that the one side thereof follows the carriage base 23 (or the first guide shaft 13) (see FIGS. 1A and 1B, and 2A and 2B). In this manner, since the recording carriage 33 and the photocuring carriage 44 are disposed so as to be physically separated from each other without coming into contact with each other, the heat generated from the first half curing portion 41, the second half curing portion 42 and the main curing unit 43 mounted on the photocuring carriage 44 is not transmitted to the recording carriage 33 (and the respective recording head 30). Thus, it is possible to prevent the occurrence of a change in the discharging amount of each ink, distortion of the recording carriage 33 or the like due to the influence of heat. As a result, it is possible to prevent the problem in that the landing positions of each ink deviate on the recording medium W, enabling the performance of the highly precise discharging of the ink.

Furthermore, in the photocuring carriage 44 (carriage side portion 55), the holding portion 57 and the holding portion 57 are connected with each other by the corner portion 59. Thus, the heat transferring area between the holding portions 57 is very small, which can suppress the transmission of the heat between the holding portions 57. Since this can exclude the mutual thermal influence among the first half curing portion 41, the second half curing portion 42 and the main curing portion 43, the light emitting performances of the respective photocuring units do not decline. Thus, the curing of ink is satisfactorily performed, whereby the drawing quality of the image can be satisfactorily maintained. In addition, the shapes of the respective holding units 57 are not limited to the square shape, and the shape of the carriage side portion 55 (the photocuring carriage 44) is not also limited to the step shape. That is, if the holding portion 57 and the holding portion 57 are connected to each other so as form the narrow part, any form may be used.

As shown in FIGS. 2A, 2B, 5A, and 5B, the carriage base 23 is a member formed of resin, and includes a shaft engagement portion 61 which is slidably engaged with the first guide shaft 13, belt fixing portions 62 in which the timing belt 16*c* is fixed therebetween, and a cantilever support mechanism 63 which supports the head unit 21 in the cantilever manner.

The shaft engagement portion 61 is concavely provided approximately circularly in a shape which is complementary to the first guide shaft 13 (half circular shaft), and is slidably engaged with the first guide shaft 13 so as to be covered from the upper part (see FIG. 2B). Furthermore, the belt fixing portions 62 protrude to the upstream side in the Y axis direction in the center of the X axis direction of the carriage base 23 and pinch the timing belt 16*c* therebetween (see FIG. 1A). In addition, the carriage apparatus 2 moves back and forth in the X axis direction so as to be dragged to the timing belt 16*c* by the driving of the servo motor 15.

Figure 5A:
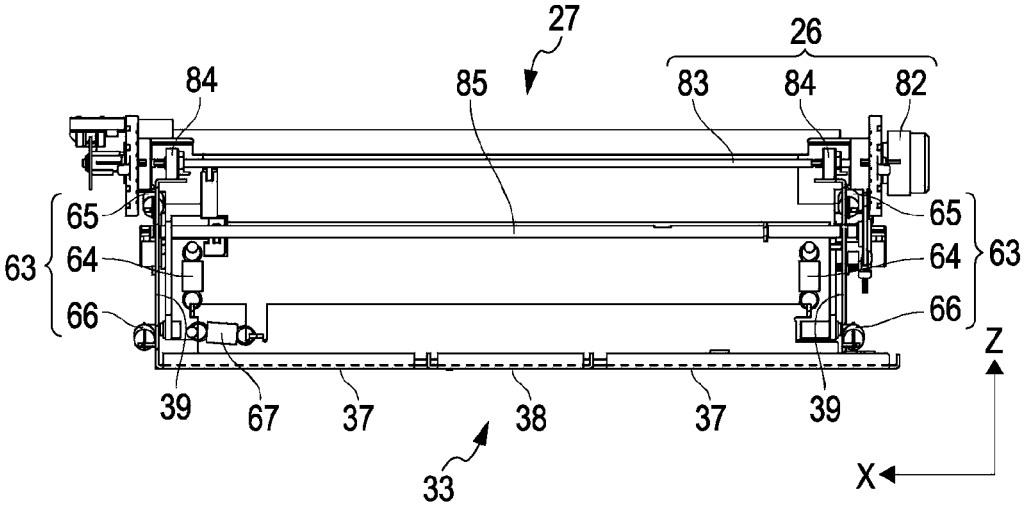
FIG. 5A is a front view of a recording carriage and a carriage base.
Figure 5B:
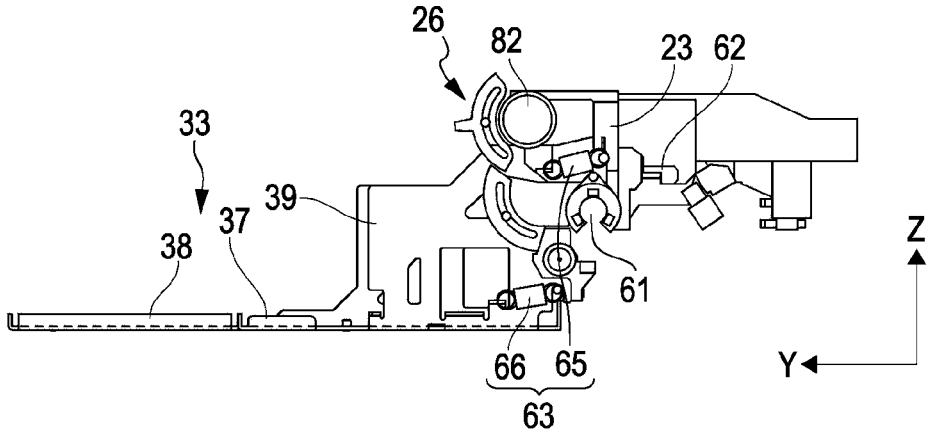
FIG. 5B is a side view thereof.

Furthermore, as shown in FIGS. 5A and 5B, the cantilever support mechanism 63 supports the head unit 21 in the cantilever manner in the Y axis direction downstream side. The cantilever support mechanism 63 includes a pair of raising springs 64 for raising the head unit 21 to the upper part, first pull spring portions 65 and a pair of second pull springs 66 for pulling the head unit 21 to the carriage base 23 side.

The pair of raising springs 64 is configured so that one end thereof is engaged with hooks provided at both ends in the X axis direction of the first head holding portion 37, respectively, and the other end thereof is engaged with convex portions protruding from both ends in the X axis direction of the carriage base 23, respectively. Furthermore, the pair of first pull springs 65 is configured so that one end thereof is engaged with hooks provided at the upper end portion of both ends in the X axis direction of the standing portion 39, respectively, and the other end thereof is engaged with hooks provided at both side upper surfaces in the X axis direction of the carriage base 23, respectively. Similarly, the pair of second pull springs 66 is configured so that one end thereof is engaged with hooks provided at the lower end portion of both ends in the X axis direction of the standing portion 39, respectively, and the other end thereof is engaged with hooks provided at both end lower sides in the X axis direction of the carriage base 23.

In addition, the head unit 21 is raised by the pair of raising springs 64 and is pressed (pressed down) by the head gap adjustment unit 26 (the details thereof will be described later). Furthermore, the head unit 21 is raised to the upstream side in the Y axis direction by the pair of first pull springs 65 and the pair of second pull springs 66, and is pressed by the parallelism adjustment unit 27 (the details thereof will be described later). As a result, the head unit 21 is supported by the carriage base 23 in the cantilever state. In addition, the X axis pull spring 67 which performs the position adjustment in the X axis direction of the head unit 21 (the recording carriage 33) is provided at the lower side of the left raising spring 64 in FIG. 5A.

As shown in FIGS. 2A and 2B, the support frame 24 connects one end portion thereof to the upper end surface of the carriage base 23, and includes a pair of girder members 71 extending to the downstream side in the Y axis direction, a pair of beam members 72 connected to the upper surface of the respective girder members 71 so as to be perpendicular thereto, and a wall member 73 hung to the other end portion of the pair of girder members 71. Furthermore, a pair of braces 74 is connected to the upper surfaces of the respective girder members 71 and the wall surface 73, which improves the strength as the structure of the support frame 24. On the surface of the downstream side in the Y axis direction of the wall member 73, a plurality (five) of rollers 75, which comes into rolling contact with the surface of the second guide shaft 14, is arranged in the X axis direction at equal intervals and is rotatably supported in a cantilever manner. In addition, the girder members 71, the beam members 72 and the braces 74 are formed of a channel material of aluminum alloy and the wall member 73 is formed of resin. Moreover, the disposition numbers of the girder members 71, the beam members 72, and the brace 74 are arbitrary.

The plurality (four) of pillar members 25 connects each one end portion to both ends of the beam members 72 and the slight downstream side from the center in the Y axis direction of the respective girder members 71, and connects the other end extending to the lower part to the photocuring carriage 44. That is, the photocuring carriage 44 is hung with respect to the support frame 24 by four pillar members 25. Four pillar members 25 are connected to the photocuring carriage 44 in the vicinity of the respective first half curing units 45 and the second half curing units 46, respectively. The photocuring carriage 44 is supported by the strong support frame 24 via four support members 25, which can effectively prevent the photocuring carriage 44 from being distorted (thermal deformation) due to the heat generated by the respective first half curing units 45 and the respective second half curing units 46. As a result, the photocuring unit 22 can be maintained to the set flatness (posture). In addition, although the details thereof will be described later, the photo gap adjustment units 28 are configured in the respective pillar members 25. Furthermore, the disposition number of the pillar members 25 is arbitrary.

In this manner, the photocuring unit 22 is slidably supported by both the first guide shaft 13 and the second guide shaft 14 via the carriage base 23 and the support frame 24 (the plurality of pillar members 25), whereby the head unit 21 and the photocuring unit 22 are situated between the first guide shaft 13 and the second guide shaft (see FIGS. 1A and 1B). That is, the carriage apparatus 2 disperses the entire weight into the first guide shaft 13 and the second guide shaft 14 and is stably supported. As a result, as a whole carriage apparatus 2, the stable posture is maintained without being vibrated during movement start and stop, whereby the carriage apparatus 2 can be moved in the X axis direction.

Furthermore, since the head unit 21 and the photocuring unit 22 are integrated as the carriage apparatus 2 and can be moved in the X axis direction at the same time, the drawing operation and the half curing operation (and the main curing operation) of the image can be continuously performed during the same movement. As a result, it is possible to effectively carry out the drawing and curing of the image in a short time, since the movement of the carriage apparatus 2 causes the head unit 21 and the photocuring unit 22 to face the whole region (the whole area to be recorded) of the recording surface F of the recording medium W, the head unit 21 and the photocuring unit 22 can be miniaturized, which can miniaturize the overall carriage apparatus 2.

As shown in FIGS. 5A and 5B, the head gap adjustment unit 26 includes an adjustment gear 82 (a reduction gear train formed by a planetary gear) connected to an adjustment motor (not shown) via a gear row 81 (see FIG. 1B), a gap adjustment shaft 83 to which the rotation is transmitted from the adjustment gear 82, and a pair of eccentric cams 84 connected to the gap adjustment shaft 83.

In this gap adjustment, firstly, when the carriage apparatus 2 is moved to the home position H, the drive shaft of the adjustment motor is connected to the gear train 81 and the gear train 81 rotates, thereby being engaged with the adjustment gear 82. In addition, the respective eccentric cams 84 rotate via the gap adjustment shaft 83 pivotally and are rotatably supported by the carriage base 23 by the driving of the adjustment motor. The respective eccentric cams 84 are in contact with the upper end surface of the respective standing portions 39 (of the first head holding portion 37) of the recording carriage 33, respectively. For this reason, together with the rotation of the respective eccentric cams 84, the recording carriage 33 (the head unit 21) is pressed down to resist the respective raising springs 64 of the above-mentioned cantilever support mechanism 63, or raised by the respective raising springs 64, whereby the recording carriage 33 moves up and down (raised or lowered). Thus, by the thickness or the type (impermeable or permeable to ink) of the recording medium W, the gap between the head unit 21 (the respective recording heads 30) and the recording medium W can be suitably changed. As a result, the ink can be optimally discharged and the drawing of the highly precise image can be performed on the recording medium W. In addition, it may be configured so that the adjustment motor may be omitted in order to perform adjustment manually, and it may be configured so that the respective eccentric cams 84 are made individually rotatable in order to perform the minute adjustment of the pitch angle.

As shown in FIGS. 5A and 5B, the parallelism adjustment unit 27 includes an eccentric shaft 85 which is in contact with the upstream side (rear side) in the Y axis direction of the respective standing portions 39. The eccentric shaft 85 is supported rotatably by the carriage base 23, whereby, together with the rotation of the eccentric shaft 85, the recording carriage 33 (the head unit 21) is extruded to resist the respective first pull springs 65 and the respective second pull springs 66 of the above-mentioned cantilever support mechanism 63 or is pulled by the respective first pull springs 65 and the respective second pull springs 66 so as to be rotated and moved in the rolling direction. In this manner, it is possible to maintain the head unit 21 (the respective recording heads 30) in parallel and to make the parallelism for each recording head 30 regular. As a result, since the respective recording heads 30 (the respective first color recording head 31*a*, first colorless recording head 31*b* and second recording head 32*a*) can face the recording medium W in parallel with suitable gaps, the optimal ink discharging is possible.

Figure 6A:
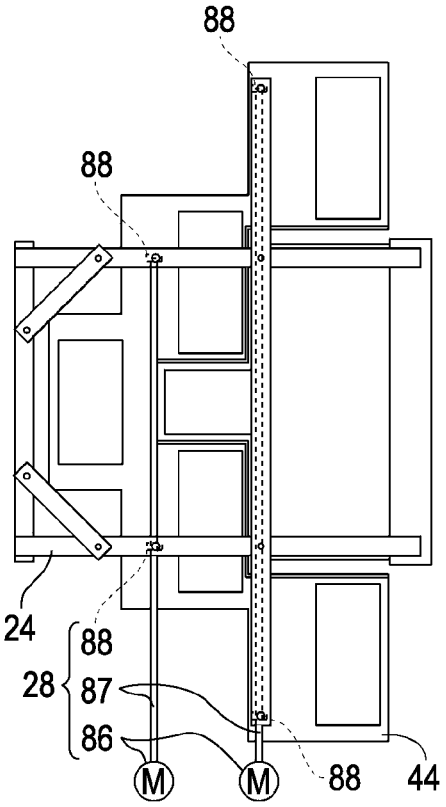
FIG. 6A is a plane view of a carriage apparatus.
Figure 6B:
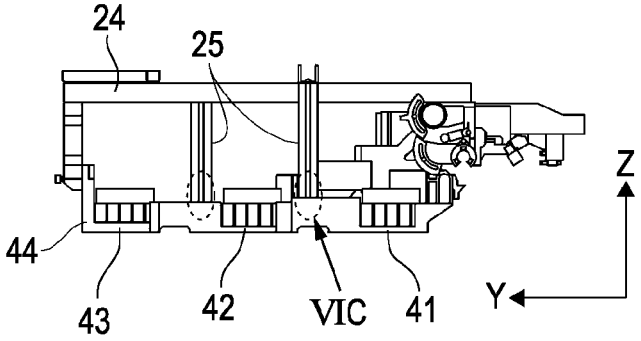
FIG. 6B is a side view thereof.
Figure 6C:
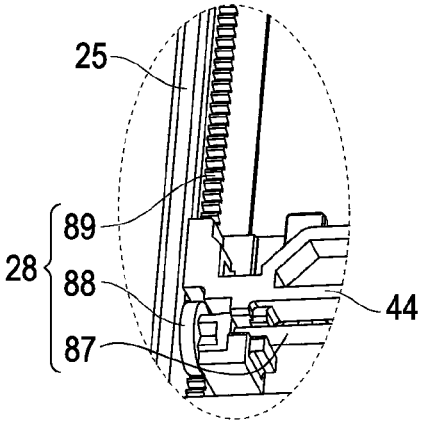
FIG. 6C is a partial enlarged view of a photo gap adjustment unit.

As shown in FIGS. 6A to 6C, the photo gap adjustment unit 28 includes two adjustment rotation shafts 87 to which the rotation from a geared motor 86 is transmitted, a pair of two groups of pinions 88 connected to the adjustment rotation shaft 87, a plurality of racks 89 with which the respective pinions 88 are engaged, and a plurality of guide mechanisms (not shown) which maintains the engagement state of the respective racks 89 and the respective pinions 88 and guides the up and down movement (lifts up and down).

The respective racks 89 are formed in the pillar member 25, and the respective adjustment rotation shafts 87 are supported rotatably with respect to the photocuring carriage 44 (see FIG. 6C). The photo gap adjustment is performed so that when the carriage apparatus 2 is moved to the home position H, the drive shafts of the respective geared motor 86 are connected to the respective adjustment rotation shaft 87. In addition, the pair of pinions 88 (see FIG. 6A) arranged in the X axis direction at the upstream side of the Y axis direction are rotated and moved along the respective racks 89 by the driving of the geared motor 86 connected to the one end of the adjustment rotation shafts 87. This is also true for the pair of pinions 88 arranged in the X axis direction at the Y axis direction downstream side. In this manner, by the rotation and movement of the respective pinions 88, the photocuring carriage 44 moves up and down (lift up and down) along the respective racks 89. For this reason, depending on the thickness and the type of the recording medium W, the gap between the photocuring unit 22 and the recording medium W can be suitably changed, whereby the optimal intensity (irradiance) of light can be irradiated, depending on the type or the like of ink or the type or the like of the recording medium W, thereby suitably curing the ink droplet on the recording medium W. In addition, the photo gap adjustment unit 28 may be provided at the upper side (or at a Z axis direction middle) of the respective pillar members 25. Furthermore, a configuration, in which the adjustment rotation shaft 87 is omitted to individually rotate the respective pinions 88, may be used. In addition, the respective pillar members 25 may be made to a box type slide structure, whereby the inner pillar and the outer pillar are screwed, thereby being lifted up and down by rotating the screw (a lead screw mechanism), and the respective pillar members 25 may be made to a cylinder and piston structure so as to be slid.

Next, with reference to FIGS. 7 to FIGS. 9A to 9C, an image forming method controlled by the control unit 6 of the ink jet recording apparatus 1 according to an embodiment of the invention will be described. In the following description, nine colors of color inks other than the colorless (CL) ink which is supplied to the first recording portion 31 are referred to as "first color ink 91", and the colorless ink is referred to as "first colorless ink 92". Similarly, the colorless ink which is supplied to the second recording portion 32 is referred to as "second ink 93". In addition, the first color ink 91 is supplied to the plurality of first color recording heads 31*a* of the first recording portion 31 and the first colorless ink 92 is supplied to the first colorless recording head 31*b*. Moreover, the colorless second ink 93 is supplied to the second recording head 32*a* of the second recording portion 32. In addition, before the operation of the image forming, the carriage apparatus 2 is situated at the home position H, whereby the gap adjustment and the parallelism adjustment of the head unit 30 (the respective recording heads 21) relative to (the recording surface F of) the recording medium W and the gap adjustment of the photocuring unit 22 are performed by the head gap adjustment unit 26, the parallelism adjustment unit 27, and the photo gap adjustment unit 28.

Figure 7:
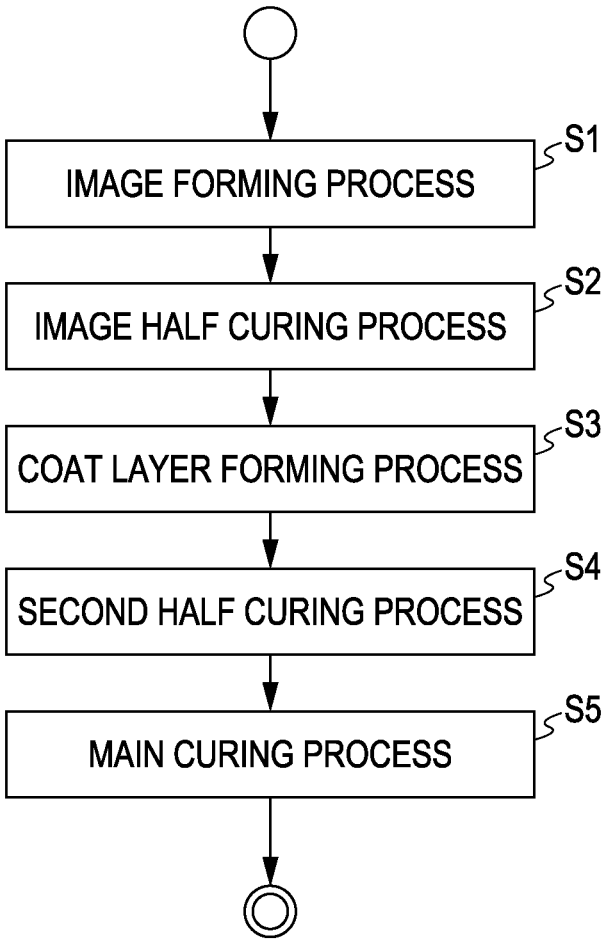
FIG. 7 is a flow chart of an image forming method according to the present embodiment.

As shown in FIG. 7, the image forming method includes an image forming process S1 which discharges the first color ink 91 and the first colorless ink 92, thereby forming a visible image D1 and an invisible image D2 on the recording medium W so as to embed the portion other than the visible image D1; an image half curing process S2 which half cures the first color ink 91 constituting the visible image D1 and the first colorless ink 92 constituting the invisible image D2 by the first half curing portion 41; a coat layer forming process S3 which discharges the second ink 93, thereby forming the coat layer D3 on the visible image D1 and the invisible image D2; a second half curing process S4 which half cures the second ink 93 constituting the coat layer D3 by the second half curing portion 42; and a main curing process S5 which mainly cures the visible image D1, the invisible image D2 and the coat layer D3 by the main curing unit 43.

In the image forming process S1 (image forming operation), with respect to the recording medium W transported to the position facing the first recording portion 31, while moving the carriage apparatus 2 back and forth in the X axis direction, the first color ink 91 is discharged from the first recording portion 31 to form (draw) the visible image D1, based on image data. Concurrently with this, a portion to which the first color ink 91 is not discharged in the image data, that is, a background portion of the visible image D1, the first colorless ink 92 is discharged to draw the invisible image D2 (see FIG. 8A). In this manner, the recording surface F of the recording medium W on which the visible image D1 and the invisible image D2 are formed is embedded with the first color ink 91 and the first colorless ink 92 (see FIG. 9A). Thus, concavity and convexity due to whether or not the landing of ink exists is not generated on the recording medium W. In addition, in the present embodiment, the discharging (drawing) of each ink is performed from the head unit 21 during reciprocating movement (during forward movement and during backward movement), but the drawing may be performed only at one side during forward movement or during backward movement.

In the image half curing process S2 (image half curing operation), while moving the carriage apparatus 2 back and forth in the X axis direction, in the image forming process S1, (ink droplets of) the first color ink 91 and the first colorless ink 92 landed on the recording medium W are half cured. For example, in a case where the carriage apparatus 2 draws the visible image D1 and the invisible image D2 during forward movement, the carriage apparatus is moved forward while irradiating the ultraviolet light using the first half curing unit 45 of the downstream side (right side in FIG. 8B) in the forward movement direction (see FIG. 8B). That is, it is possible to perform the half curing immediately after the first color ink 91 and the first colorless ink 92 are discharged. In this case, together with the movement for drawing, the half curing of the respective ink droplets on the recording medium W can be performed, which makes it possible to form (draw and half cure) the visible image D1 and the invisible image D2 in a short time.

In addition, only the drawing may be performed during forward movement and the half curing may be performed using the first half curing unit 45 of the downstream side in the backward direction during backward movement. In this case, since it takes time until ultraviolet light is irradiated, each ink droplet on the recording medium W is largely wet and spreads, becoming a smooth surface in which concavity and convexity are further suppressed. In this manner, the time up to the half curing of the first color ink 91 and the first colorless ink 92 can be controlled, whereby the respective surface roughness of the visible image D1 and the invisible image D2 can be arbitrarily set. Furthermore, since the size of each ink droplet becomes regular by the half curing, in addition to the color mixing prevention of each ink, it is possible to suppress and flatten the concavity and convexity of the surface of the visible image D1 and the invisible image D2. As a result, it is possible to form the flat and smooth coat layer D3 in the subsequent process.

When the image forming process S1 and the image half curing process S2 are completed, the portion in which the visible image D1 and the invisible image D2 of the recording medium W are drawn is moved to the Y axis direction downstream side up to the position facing the second recording portion 32 by the medium transport mechanism 12 and is fixed on the platen 17 again. In addition, with respect to the drawn visible image D1 and the invisible image D2, the coat layer forming process S3 is continuously performed.

Figure 8A:
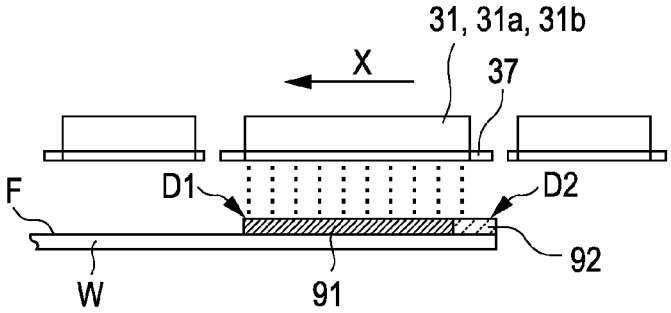
FIGS. 8A to 8E are illustration diagrams (side views) that schematically show a pattern in which a visible image, an invisible image, and a coat layer are formed in an image forming method according to the present embodiment.
Figure 8B:
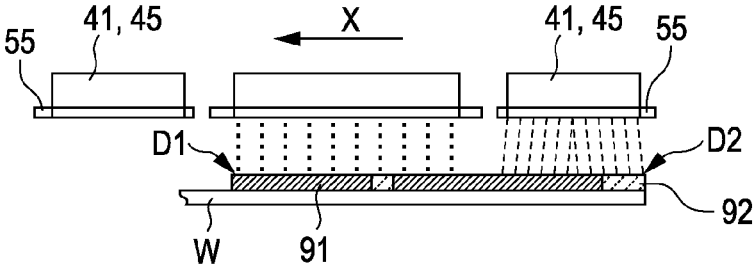
Figure 8C:
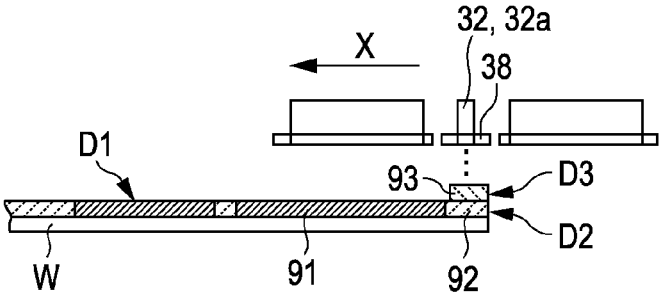

In the coat layer forming process S3 (coat layer forming operation), the second ink 93 is discharged from the second recording portion 32, while moving the carriage apparatus 2 back and forth in the X axis direction, thereby protecting the visible image D1 and the invisible image D2 and forming the transparent coat layer D3 for giving gloss (see FIG. 8C). As described above, the recording medium W (recording surface F) is embedded with the half-cured visible image D1 and invisible image D2, whereby the concave and convex due to the ink droplet was not generated on the recording medium W. As a result, since the second ink 93 is discharged onto the foundation (the visible image D1 and the invisible image D2) where the concave and convex does not exist, it is possible to form the coat layer D3 which does not have the concave and convex but has satisfactory gloss. In addition, in the same manner as the image forming process S1, in the coat layer forming process S3, the second ink 93 is also discharged during forward and backward movement (during forward movement and during backward movement), but the coat layer forming operation may be performed in only one of during forward movement and during backward movement.

Figure 8D:
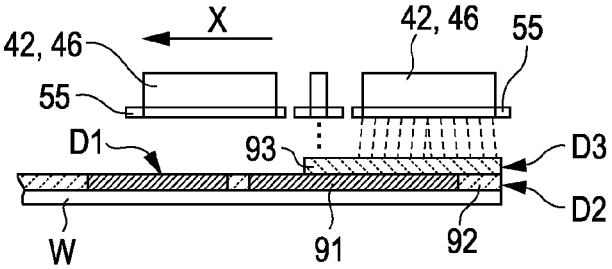

In the second half curing process S4 (coat layer half curing operation), in the same manner as the image half curing process S2, the second ink 93 landed on the visible image D1 and the invisible image D2 in the coat layer forming process S3 is half cured using the second half curing unit 46, while moving the carriage apparatus 2 back and forth in the X axis direction (see FIG. 8D). As a result, together with the coat layer forming operation, and continuously, or with time intervals, the half curing of the second ink 93 can be performed, whereby the surface roughness of the coat layer D3 can be regulated. In addition, the visible image D1 (the first color ink 91) and the invisible image D2 (the first colorless ink 92) are half cured, so that the second ink 93 is not color-mixed.

As described above, the irradiance of the ultraviolet light irradiated by the second half curing unit 46 is set to be lower than the first half curing unit 45, in the second half curing process S4, each ink droplet of the second ink 93 is half cured in the state liable to wet and spread. As a result, the coat layer D3 has the smooth surface without concave and convex on the visible image D1 and the invisible image D2 and can have further beautiful gloss. Furthermore, the by controlling the irradiance of ultraviolet light to adjust the wetting spread of the second ink 93, a configuration, in which an arbitrary gloss adjustment such as a matt adjustment (gloss removal), a gloss adjustment (gloss exists) or the like is performed, may be used.

When the coat layer forming process S3 and the second half curing process S4 are completed, the portion where the visible image D1, the invisible image D2 and the coat layer D3 of the recording medium W are formed is moved up to the position facing the main curing unit 43 in the Y axis direction downstream side by the medium transport mechanism 12, and is fixed on the platen 17 again. In addition, the continuous main curing process S5 is performed with respect to the formed visible image D1 the invisible image D2 and the coat layer D3.

Figure 8E:
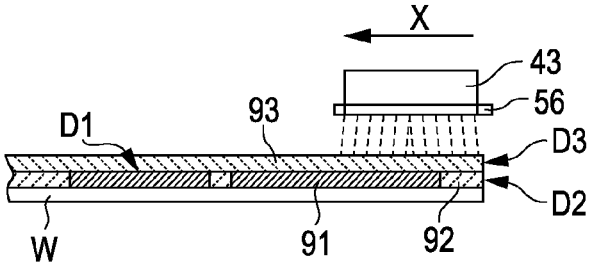

In the main curing process S5 (main curing operation), while moving the carriage apparatus 2 back and forth in the X axis direction, the main curing unit 43 mainly cures the visible image D1, the invisible image D2 and the coat layer D3 (see FIG. 8E). In this case, since the visible image D1, the invisible image D2, and the coat layer D3 are half cured in advance, it is possible to reduce the time taken in the main curing operation. Furthermore, since the visible image D1, the invisible image D2 and the coat layer D3 are completely cured, even if the recording medium W in which the drawing is completed is sequentially overlapped, the drawing result (image) does not collapse and the ink pollution is not transferred.

Figure 9A:
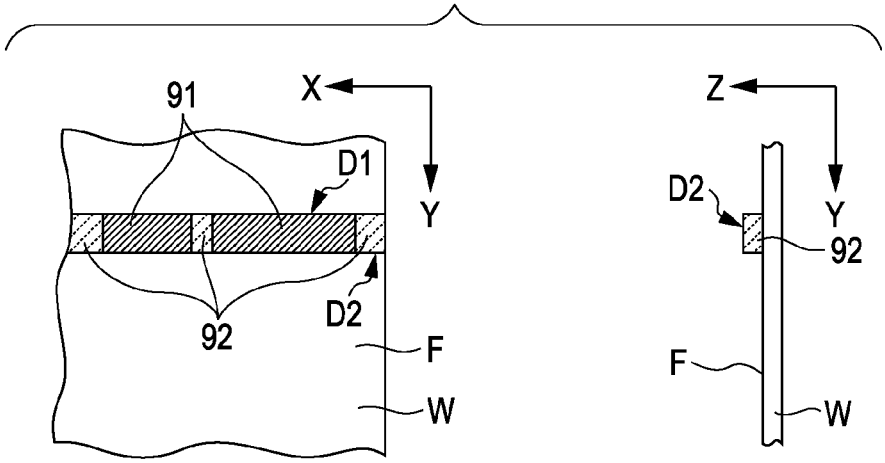
FIGS. 9A to 9C are illustration diagrams (plane views) that schematically show a pattern in which a visible image, an invisible image, and a coat layer are formed in an image forming method according to the present embodiment.
Figure 9B:
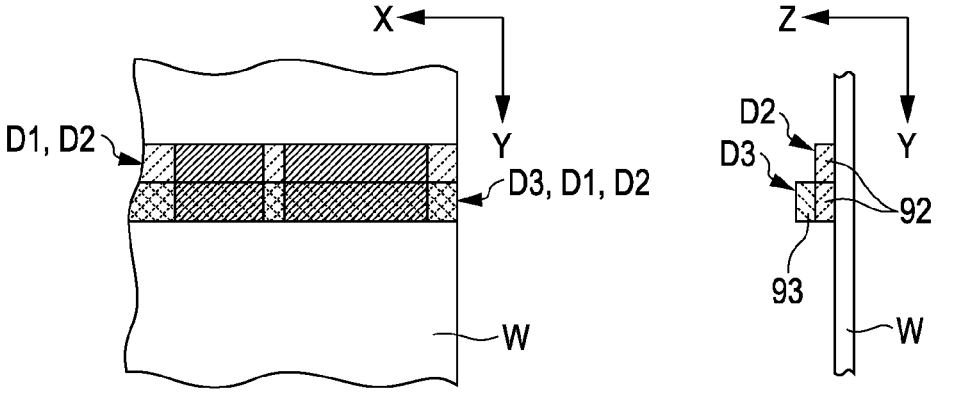
Figure 9C:
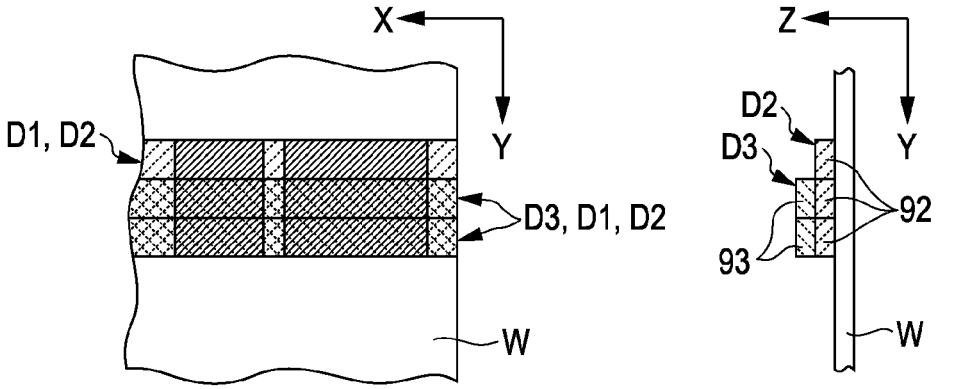

In addition, when the coat layer forming process S3 and the second half curing process S4 are performed, the image forming process S1 and the image half curing process S2 are concurrently performed at the Y axis direction upstream side (see FIG. 9B). Similarly, when performing the main curing process S5, the coat layer forming process S3 and the second half curing process S4, the image forming process S1 and the image half curing process S2 are concurrently performed at the Y axis direction upstream side, respectively (see FIG. 9C). That is, in the ink jet recording apparatus 1 of the present embodiment, it is possible to concurrently and continuously perform (1) the drawing and half curing of the visible image D1 and the invisible image D2, (2) the forming and the half curing of the coat layer D3, (3) the main curing of the visible image D1, the invisible image D2 and the coat layer D3, in the same main scan (movement in the X axis direction). As a result, it is possible to effectively form the visible image D1, the invisible image D2, and the coat layer D3 on the recording medium W.

In addition, (the sequence of) the above-mentioned image forming method is an example, and each process may be performed in any time of during forward movement or during backward movement of at least the carriage apparatus 2. For example, the image forming process S1, the image half curing process S2, and the main curing process S5 may be performed when the carriage apparatus 2 is moved forward, and the coat layer forming process S3 and the second half curing process S4 may be performed during backward movement.

According to the configuration mentioned above, the heat generated from the photocuring unit 22 is not easily transmitted to the head unit 21 (the recording head 30 and the recording carriage 33), which can prevent a decline in the discharging accuracy of the respective recording heads 30 due to heat, thereby forming a highly precise image with respect to the recording medium W.

Second Embodiment

The ultraviolet curable ink can control the curing method even by using the addition amount (time receiving ultraviolet light) of the received ultraviolet light, in addition to the irradiance (illuminance) of the received ultraviolet light.

Therefore, by shortening (miniaturizing) the X axis direction lengths of the respective second half curing units 46 compared to that of the first half curing unit 45, the ultraviolet light irradiation time may be shortened with respect to the second ink 93 on the recording medium W. That is, by reducing the areas of the light irradiation portions 51 of the respective second half curing units 46, the addition amount, which is received by the second ink 93 on the recording medium W, is reduced. As a result, in the same manner as the first embodiment, the second ink 93 is liable to be wet and spread, enabling the formation of the flat and smooth coat layer D3. In addition, on the contrary, if high irradiation in the curing of the second ink 93 is required, the sizes in the X axis direction of the respective second half curing units 46 may be longer than those of the respective first half curing units 45 (the area of the light irradiation portion 51 is large).

What is claimed is:

1. A carriage apparatus of an ink jet recording apparatus that discharges a photocurable ink and photocures the discharged ink, while relatively being moved with respect to a recording medium in a main scan direction and a sub scan direction, thereby forming a desired image on the recording medium, comprising:

a plurality of recording heads for discharging the ink with respect to the recording medium;

a recording carriage on which the plurality of recording heads is mounted so as to be divided into a plurality of recording portions in the sub scan direction;

a plurality of photocuring units which are disposed on outer sides of the respective recording portions in the main scan direction and the sub scan direction to photocure the ink on the recording medium; and a photocuring carriage on which the plurality of photocuring units is mounted and which is disposed to be separated from the recording carriage, wherein the photocuring carriage includes a first portion and a second portion that are symmetrically situated on, respectively, first and second sides of the recording carriage in the main scanning direction, wherein the photocuring carriage includes a carriage connection portion connecting the first and second portions, the carriage connection portion located on a downstream side of the recording carriage in a sub-scanning direction, wherein, in the photocuring carriage, a plurality of holding portions for holding the respective photocuring units are connected together to form a narrow part, wherein at least one of the photocuring units is arranged between a pair of photocuring units of the plurality of photocuring units in the sub scan direction, the at least one of the photocuring units overlapping in the sub scan direction at least one of the recording heads and both of the pair of photocuring units, wherein at least one of the holding portions is arranged in the sub-scanning direction relative to the recording head, and at least one of the holding portions holds at least one of the photocuring units which is arranged overlapping at least one of the recording heads in the sub-scanning direction.

2. The carriage apparatus according to claim 1, wherein the plurality of photocuring units is disposed at both outer sides of the respective recording portions in the main scan direction, wherein the photocuring carriage has a pair of carriage side portions in which the plurality of holding portions forms the narrow part and is connected to each other and which are symmetrically situated at both sides in the main scan direction of the plurality recording portions, and a carriage connection portion that connects the pair of carriage side portions.

3. The carriage apparatus according to claim 1, wherein the recording carriage is supported so as to be movable with respect to a guide shaft in the main scan direction, in an upstream side of the sub scan direction, and wherein the plurality of recording portions is disposed from the guide shaft toward a downstream side of the sub scan direction, in order from the recording portion that mounts the greatest number of recording heads.

4. The carriage apparatus according to claim 1, wherein mutual confronting sides of the recording carriage and the photocuring carriage are formed in a complementary shape and in a step shape, respectively.

5. The carriage apparatus according to claim 1, further comprising:

a photo gap adjustment unit which adjusts gaps between the plurality of photocuring units and the recording medium via the photocuring carriage.

6. The carriage apparatus according to claim 1, further comprising:

a head gap adjustment unit which adjusts gaps between the plurality of recording heads and the recording medium via the recording carriage.

7. The carriage apparatus according to claim 1, wherein the respective photocuring units have a light irradiation portion which irradiates light for photocuring the ink, and a cooling portion which is disposed in a rear side of the light irradiation unit and cools the light irradiation portion, and wherein the photocuring carriage has a rib which protrudes to the recording carriage side to shield the discharged heat from the cooling portion.

8. An ink jet recording apparatus comprising:

the carriage apparatus of the ink jet recording apparatus according to claim 1, and a movement unit which moves the carriage apparatus in the main scan direction and moves the recording medium in the sub scan direction.

9. The carriage apparatus according to claim 1, wherein the first portion is located on the first side of the recording carriage and the second portion is located on the second side of the recording carriage, wherein the first portion and the second portion of the photocuring carriage are integrally formed with the carriage connection portion.

10. The carriage apparatus according to claim 1, wherein at least some of the holding portions are connected by a corner portion.

11. The carriage apparatus according to claim 1, wherein the recording carriage is supported in a cantilever manner on a carriage base.

12. The carriage apparatus according to claim 1, wherein the photocuring carriage has a stepped outer perimeter and a stepped interior perimeter in the main scan direction, the stepped interior perimeter forming an interior space to receive a portion of the recording carriage, the photocuring carriage overlapping the recording carriage on one side in the sub scan direction and one side in the main scan direction.

* * * * *